US008969265B2

(12) United States Patent
Bhalla et al.

(10) Patent No.: US 8,969,265 B2
(45) **Date of Patent: *Mar. 3, 2015**

(54) LUBRICATING OIL COMPOSITIONS

(71) Applicant: Chevron Oronite Company LLC, San Ramon, CA (US)

(72) Inventors: Gaurav Bhalla, Hercules, CA (US); Elaine S. Yamaguchi, El Cerrito, CA (US); Man Hon Tsang, Richmond, CA (US)

(73) Assignee: Chevron Oronite Company LLC, San Ramon, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/219,342

(22) Filed: Mar. 19, 2014

(65) Prior Publication Data

US 2014/0206586 A1 Jul. 24, 2014

Related U.S. Application Data

(63) Continuation of application No. 12/653,497, filed on Dec. 15, 2009, now Pat. No. 8,709,984.

(51) Int. Cl.

| | |
|---|---|
| ***C10M 139/00*** | (2006.01) |
| ***C10M 159/24*** | (2006.01) |
| ***C10M 159/18*** | (2006.01) |
| ***C07C 55/02*** | (2006.01) |
| ***C10M 169/04*** | (2006.01) |
| ***C10M 141/12*** | (2006.01) |

(52) U.S. Cl.

CPC ..... *C10M 169/044* (2013.01); *C10M 141/12* (2013.01); *C10M 2203/1006* (2013.01); *C10M 2203/1025* (2013.01); *C10M 2205/022* (2013.01); *C10M 2207/026* (2013.01); *C10M 2215/086* (2013.01); *C10M 2227/065* (2013.01); *C10N 2230/06* (2013.01); *C10N 2230/42* (2013.01); *C10N 2230/43* (2013.01); *C10N 2230/45* (2013.01); *C10N 2240/10* (2013.01)

USPC ..... 508/108; 508/384; 508/391; 508/398; 508/506

(58) Field of Classification Search

USPC ..... 508/268, 108, 384, 370, 506, 398

See application file for complete search history.

(56) References Cited

U.S. PATENT DOCUMENTS

| | | | |
|---|---|---|---|
| 3,036,003 | A | 5/1962 | Dolton |
| 3,172,892 | A | 3/1965 | Le Suer et al. |
| 3,219,666 | A | 11/1965 | Norman et al. |
| 3,272,746 | A | 9/1966 | Le Suer et al. |
| 3,275,554 | A | 9/1966 | Wagenaar |
| 3,329,658 | A | 7/1967 | Fields |
| 3,438,757 | A | 4/1969 | Honnen |
| 3,449,250 | A | 6/1969 | Fields |
| 3,454,555 | A | 7/1969 | Vander Voort et al. |
| 3,565,804 | A | 2/1971 | Honnen et al. |
| 3,586,629 | A | 6/1971 | Otto |
| 3,591,598 | A | 7/1971 | Traise et al. |
| 3,666,730 | A | 5/1972 | Coleman |
| 3,980,569 | A | 9/1976 | Pindar et al. |
| 4,234,435 | A | 11/1980 | Meinhardt et al. |
| 4,612,132 | A | 9/1986 | Wollenberg et al. |
| 4,746,446 | A | 5/1988 | Wollenberg et al. |
| 5,260,466 | A | 11/1993 | McGibbon |
| 5,716,912 | A | 2/1998 | Harrison et al. |
| 5,726,134 | A | 3/1998 | Adams |
| 6,153,565 | A | 11/2000 | Skinner et al. |
| 6,165,235 | A | 12/2000 | Kolp et al. |
| 6,281,179 | B1 | 8/2001 | Skinner et al. |
| 6,372,696 | B1 | 4/2002 | Tipton |
| 6,429,178 | B1 | 8/2002 | Skinner et al. |
| 6,429,179 | B1 | 8/2002 | Skinner et al. |
| 6,440,905 | B1 | 8/2002 | Epps et al. |
| 2006/0014651 | A1 | 1/2006 | Esche et al. |
| 2007/0111908 | A1 | 5/2007 | Lam et al. |
| 2007/0149418 | A1 | 6/2007 | Esche et al. |
| 2008/0139429 | A1 * | 6/2008 | Guinther ..... 508/287 |
| 2008/0223330 | A1 | 9/2008 | Lam et al. |
| 2008/0277203 | A1 | 11/2008 | Guinther |

FOREIGN PATENT DOCUMENTS

WO 2006105022 A1 10/2006

OTHER PUBLICATIONS

The IP.com Journal 7, vol. 2, 9 pp. 57-58 (Sep. 2002) announcing that Yamaguchi, E.S., Friction and Wear Measurements Using a Modified MTM Tribometer, pp. 1-33 published on IP.com on Aug. 7, 2002 as No. IPCOM000009117D.

The Office Action issued in counterpart Japanese Patent Application No. 2012-544526 dated May 2, 2014.

* cited by examiner

*Primary Examiner* — Vishal Vasisth

(57) ABSTRACT

A lubricating oil composition is disclosed which comprises (a) a major amount of an oil of lubricating viscosity; (b) one or more non-halogen-containing oil-soluble titanium complexes comprising at least one ligand comprising an anion of a carboxylic acid; (c) one or more dispersants; and (d) one or more detergents, wherein the lubricating oil composition is free of any zinc dialkyldithiophosphate.

10 Claims, No Drawings

LUBRICATING OIL COMPOSITIONS

PRIORITY

This application is a CON of Ser. No. 12/653,497, filed Dec. 25, 2009, now U.S. Pat. No. 8,709,984.

BACKGROUND OF THE INVENTION

1. Technical Field

The present invention generally relates to lubricating oil compositions.

2. Description of the Related Art

Automobile spark ignition and diesel engines have valve train systems, including valves, cams and rocker arms, which present special lubrication concerns. It is extremely important that the lubricant, i.e., the engine oil, protects these parts from wear. It is also important for the engine oils to suppress the production of deposits in the engines. Such deposits are produced from non-combustibles and incomplete combustion of hydrocarbon fuels (e.g., gasoline and diesel fuel oil) and by the deterioration of the engine oil employed.

Engine oils typically use a mineral oil or a synthetic oil as a base oil. However, simple base oils alone do not provide the necessary properties to provide the necessary wear protection, deposit control, etc., required to protect internal combustion engines. Thus, base oils are formulated with various additives, for imparting auxiliary functions, such as ashless dispersants, metallic detergents (i.e., metal-containing detergents), antiwear agents, antioxidants (i.e., oxidation inhibitors), viscosity index improvers and the like to give a formulated oil (i.e., a lubricating oil composition).

A number of such engine oil additives are known and employed in practice. For example, zinc dialkyldithiophosphates are usually contained in the commercially available internal composition engine oils, especially those used for automobiles, because of their favorable characteristics as an antiwear agent and performance as an oxidation inhibitor.

However, a problem associated with the use of zinc dialkyldithiophosphate is that their phosphorus and sulfur derivatives poison the catalyst components of the catalytic converters. This is a major concern as effective catalytic converters are needed to reduce pollution and to meet governmental regulation designed to reduce toxic gases such as, for example, hydrocarbons, carbon monoxide and nitrogen oxides, in internal combustion engine exhaust emissions. Such catalytic converters generally use a combination of catalytic metals, e.g., platinum and metal oxides, and are installed in the exhaust streams, e.g., the exhaust pipes of automobiles, to convert the toxic gases to nontoxic gases. As previously mentioned, these catalyst components are poisoned by the phosphorus and sulfur components, or the phosphorus and sulfur decomposition product of the zinc dialkyldithiophosphate; and accordingly, the use of engine oils containing phosphorus and sulfur additives may substantially reduce the life and effectiveness of catalytic converters.

There is also governmental and automotive industry pressure towards reducing the phosphorus and sulfur content. For example, current GF-4 motor oil specifications require a finished oil to contain less than 0.08 wt % and 0.7 wt % phosphorus and sulfur, respectively, and CJ-4 motor oil specifications, the most current generation heavy duty diesel engine oil, require an oil to contain less than 0.12 wt % and 0.4 wt % phosphorus and sulfur, respectively, and 1.0 wt % sulfated ash. It is widely believed that lowering these limits may have a serious impact on engine performance, engine wear, and oxidation of engine oils. This is because historically a major contributor to the phosphorus content in engine oils has been zinc dialkyldithiophosphates. Accordingly, it would be desirable to eliminate the amount of zinc dialkyldithiophosphate in lubricating oils, thus reducing catalyst deactivation and hence increasing the life and effectiveness of catalytic converters while also meeting future industry standard proposed phosphorus and sulfur contents in the engine oil. However, simply decreasing the amount of zinc dialkyldithiophosphate presents problems because this necessarily lowers the antiwear properties and oxidation inhibition properties of the lubricating oil. Therefore, it is necessary to find a way to reduce or eliminate phosphorus and sulfur content while still retaining the antiwear properties of the higher phosphorus and sulfur content engine oils.

U.S. Patent Application Publication No. 20070111908 ("the '908 application") discloses a lubricating oil composition containing an oil of lubricating viscosity, at least one succinimide dispersant derived from a polyalkylene compound having from about 50 to about 85% vinylidene double bonds in the compound, a metal containing detergent, at least one wear reducing agent, at least one antioxidant, and a hydrocarbon soluble titanium compound which is a reaction product of a titanium alkoxide and an about $C_6$ to about $C_{25}$ carboxylic acid as a friction modifier, wherein the lubricating oil composition is substantially free of molybdenum compounds. The '908 application further discloses that the wear reducing agent is at least one metal dihydrocarbyl dithiophosphate compound such as a zinc dihydrocarbyl dithiophosphate.

U.S. Patent Application Publication No. 20070149418 ("the '418 application") discloses a lubricating oil composition containing (a) an oil of lubricating viscosity, (b) a friction modifier selected from the group consisting essentially of an organomolybdenum friction modifier, a glycerol ester friction modifier, and mixtures thereof, and (c) an antiwear agent comprising an amount of at least one hydrocarbon soluble titanium compound effective to provide an increase in antiwear properties of the lubricant composition greater than an increase in antiwear properties of the lubricant composition devoid of the hydrocarbon soluble titanium compound, wherein the compound is essentially devoid of sulfur and phosphorus atoms. The '418 application further discloses that the hydrocarbon soluble titanium compound is a reaction product of a titanium alkoxide and an about $C_6$ to about $C_{25}$ carboxylic acid. All of the examples disclosed in the '418 application disclose a hydrocarbon soluble titanium compound in combination with a zinc dithiophosphate.

Therefore, as demand for further decrease of the phosphorus content and a limit on the sulfur content of lubricating oils is very high, this reduction cannot be satisfied by the present measures in practice and still meet the severe antiwear and oxidation-corrosion inhibiting properties required of today's engine oils. Accordingly, it would be desirable to develop lubricating oil compositions having relatively low levels or free of any phosphorus content while also having relatively low levels of sulfur and sulfated ash but which still provide the needed wear protection now provided by lubricating oils containing a zinc dialkyldithiophosphate. It would also be desirable to develop lubricating oil compositions which are free of any zinc dialkyldithiophosphate.

SUMMARY OF THE INVENTION

In accordance with one embodiment of the present invention, a lubricating oil composition is provided which comprises (a) a major amount of an oil of lubricating viscosity; (b) one or more non-halogen-containing oil-soluble titanium complexes comprising at least one ligand comprising an anion of a carboxylic acid; (c) one or more dispersants; and (d) one or more detergents, wherein the lubricating oil composition is free of any zinc dialkyldithiophosphate.

In accordance with a second embodiment of the present invention, a method of reducing wear of metal parts in an internal combustion engine is provided comprising operating the engine with a lubricating oil composition comprising (a) a major amount of an oil of lubricating viscosity; (b) one or more non-halogen-containing oil-soluble titanium complexes comprising at least one ligand comprising an anion of a carboxylic acid; (c) one or more dispersants; and (d) one or more detergents, wherein the lubricating oil composition is free of any zinc dialkyldithiophosphate.

In accordance with a third embodiment of the present invention, there is provided an internal combustion engine lubricated with a lubricating oil composition comprising (a) a major amount of an oil of lubricating viscosity; (b) one or more non-halogen-containing oil-soluble titanium complexes comprising at least one ligand comprising an anion of a carboxylic acid; (c) one or more dispersants; and (d) one or more detergents, wherein the lubricating oil composition is free of any zinc dialkyldithiophosphate.

By employing the one or more non-halogen-containing oil-soluble titanium complexes comprising at least one ligand comprising an anion of a carboxylic acid disclosed herein in a lubricating oil composition of the present invention in the absence of any zinc dialkyldithiophosphate, it has unexpectedly been discovered that the lubricating oil composition advantageously possesses improved or relatively comparable wear reducing properties as compared to a corresponding lubricating oil composition in which the non-halogen-containing oil-soluble titanium complexes comprising at least one ligand comprising an anion of a monocarboxylic acid disclosed herein in the lubricating oil composition is replaced with a zinc dialkyl dithiophosphate compound or a different titanium complex. In addition, the wear reducing properties can be achieved with the lubricating oil compositions of the present invention while also employing relatively low levels or free of any phosphorus content as well as relatively low levels of sulfur and sulfated ash.

DETAILED DESCRIPTION OF THE PREFERRED EMBODIMENTS

Definitions

The term "Total Base Number" or "TBN" refers to the equivalent number of milligrams of KOH needed to neutralize 1 gram of a product. Therefore, a high TBN reflects strongly overbased products and, as a result, a higher base reserve for neutralizing acids. The TBN of a product can be determined by ASTM Standard No. D2896 or equivalent procedure. Lubricants with higher TBN have a greater alkalinity reserve than low TBN lubricants, i.e., they can neutralize a greater quantity of acidic species.

All concentrations of materials disclosed in this application, unless otherwise specified, are on an "actives" basis; that is, the concentrations reported do not include, e.g., diluent or unreacted starting materials or intermediates.

The present invention is directed to a lubricating oil composition containing at least (a) a major amount of an oil of lubricating viscosity; (b) one or more non-halogen-containing oil-soluble titanium complexes comprising at least one ligand comprising an anion of a carboxylic acid; (c) one or more dispersants; and (d) one or more detergents, wherein the lubricating oil composition is free of any zinc dialkyldithiophosphate. In one embodiment, a lubricating oil composition of the present invention contains at least (a) a major amount of an oil of lubricating viscosity; (b) one or more non-halogen-containing oil-soluble titanium complexes comprising at least one ligand comprising an anion of a monocarboxylic acid; (c) one or more dispersants; and (d) one or more detergents, wherein the lubricating oil composition is free of any zinc dialkyldithiophosphate, and further wherein the lubricating oil composition is substantially free of any phosphorus, and has less than about 0.2 wt. % of sulfur and a sulfated ash content of no more than about 0.9 wt. % as determined by ASTM D874. The term "substantially free" as used herein shall be understood to mean relatively little to no amount of any phosphorus, e.g., an amount less than about 0.01 wt. %

In another embodiment, a lubricating oil composition contains at least (a) a major amount of an oil of lubricating viscosity; (b) one or more non-halogen-containing oil-soluble titanium complexes comprising at least one ligand comprising an anion of a monocarboxylic acid; (c) one or more dispersants; and (d) one or more detergents, wherein the lubricating oil composition is free of any zinc dialkyldithiophosphate, and further wherein the lubricating oil composition has less than 0.05 wt. % of phosphorus, less than about 0.3 wt. % of sulfur and a sulfated ash content of no more than about 0.9 wt. % as determined by ASTM D874.

In another embodiment, a lubricating oil composition contains at least (a) a major amount of an oil of lubricating viscosity; (b) one or more non-halogen-containing oil-soluble titanium complexes comprising at least one ligand comprising an anion of a monocarboxylic acid; (c) one or more dispersants; and (d) one or more detergents, wherein the lubricating oil composition is free of any zinc dialkyldithiophosphate, and further wherein the lubricating oil composition has less than about 0.4 wt. % of sulfur and a sulfated ash content of no more than about 1.0 wt. % as determined by ASTM D874.

The amount of phosphorus and sulfur in the lubricating oil composition of the present invention is measured according to ASTM D4951.

The oil of lubricating viscosity for use in the lubricating oil compositions of the present invention, also referred to as a base oil, is typically present therein in a major amount, e.g., an amount of greater than 50 wt. %, preferably greater than about 70 wt. %, more preferably from about 80 to about 99.5 wt. % and most preferably from about 85 to about 98 wt. %, based on the total weight of the composition. The expression "base oil" as used herein shall be understood to mean a base stock or blend of base stocks which is a lubricant component that is produced by a single manufacturer to the same specifications (independent of feed source or manufacturer's location); that meets the same manufacturer's specification; and that is identified by a unique formula, product identification number, or both.

The base oil for use herein can be any presently known or later-discovered oil of lubricating viscosity used in formulating lubricating oil compositions for any and all such applications, e.g., engine oils, marine cylinder oils, functional fluids such as hydraulic oils, gear oils, transmission fluids, etc. The selection of the particular base oil depends on the contemplated application of the lubricant and the presence of other additives. For example, the oil of lubricating viscosity useful in the practice of the invention may range in viscosity from light distillate mineral oils to heavy lubricating oils such as gasoline engine oils, mineral lubricating oils and heavy duty diesel oils. Additionally, the base oils for use herein can optionally contain viscosity index improvers, e.g., polymeric alkylmethacrylates; olefinic copolymers, e.g., an ethylene-propylene copolymer or a styrene-butadiene copolymer; and the like and mixtures thereof. The lubricating oil compositions of this invention can be prepared by admixing, by conventional techniques, an appropriate amount of the one or more non-halogen-containing oil-soluble titanium complexes disclosed herein with an oil of lubricating viscosity and conventional lubricating oil additives. Alternatively, the lubricating oil compositions of this invention can be prepared by admixing, by conventional techniques, an appropriate amount of the one or more non-halogen-containing oil-soluble titanium complexes disclosed herein in an additive concentrate with an oil of lubricating viscosity and conventional lubricating oil additives.

As one skilled in the art would readily appreciate, the viscosity of the base oil is dependent upon the application. Accordingly, the viscosity of a base oil for use herein will ordinarily range from about 2 to about 2000 centistokes (cSt) at 100° Centigrade (C). Generally, individually the base oils used as engine oils will have a kinematic viscosity range at 100° C. of about 2 cSt to about 30 cSt, preferably about 3 cSt to about 16 cSt, and most preferably about 4 cSt to about 12 cSt and will be selected or blended depending on the desired end use and the additives in the finished oil to give the desired grade of engine oil, e.g., a lubricating oil composition having an SAE Viscosity Grade of 0W, 0W-20, 0W-30, 0W-40, 0W-50, 0W-60, 5W, 5W-20, 5W-30, 5W-40, 5W-50, 5W-60, 10W, 10W-20, 100W-30, 10W-40, 10W-50, 15W, 15W-20, 15W-30 or 15W-40. Oils used as gear oils can have viscosities ranging from about 2 cSt to about 2000 cSt at 100° C.

Base stocks may be manufactured using a variety of different processes including, but not limited to, distillation, solvent refining, hydrogen processing, oligomerization, esterification, and rerefining. Rerefined stock shall be substantially free from materials introduced through manufacturing, contamination, or previous use. The base oil of the lubricating oil compositions of this invention may be any natural or synthetic lubricating base oil. Suitable hydrocarbon synthetic oils include, but are not limited to, oils prepared from the polymerization of ethylene or from the polymerization of 1-olefins to provide polymers such as polyalphaolefin or PAO oils, or from hydrocarbon synthesis procedures using carbon monoxide and hydrogen gases such as in a Fischer-Tropsch process. For example, a suitable base oil is one that comprises little, if any, heavy fraction; e.g., little, if any, lube oil fraction of viscosity 20 cSt or higher at 100° C.

The base oil may be derived from natural lubricating oils, synthetic lubricating oils or mixtures thereof. Suitable base oil includes base stocks obtained by isomerization of synthetic wax and slack wax, as well as hydrocracked base stocks produced by hydrocracking (rather than solvent extracting) the aromatic and polar components of the crude. Suitable base oils include those in all API categories I, II, III, IV and V as defined in API Publication 1509, 14th Edition, Addendum I, December 1998. Group IV base oils are polyalphaolefins (PAO). Group V base oils include all other base oils not included in Group I, II, III, or IV. Although Group II, III and IV base oils are preferred for use in this invention, these preferred base oils may be prepared by combining one or more of Group I, II, III, IV and V base stocks or base oils.

Useful natural oils include mineral lubricating oils such as, for example, liquid petroleum oils, solvent-treated or acid-treated mineral lubricating oils of the paraffinic, naphthenic or mixed paraffinic-naphthenic types, oils derived from coal or shale, animal oils, vegetable oils (e.g., rapeseed oils, castor oils and lard oil), and the like.

Useful synthetic lubricating oils include, but are not limited to, hydrocarbon oils and halo-substituted hydrocarbon oils such as polymerized and interpolymerized olefins, e.g., polybutylenes, polypropylenes, propylene-isobutylene copolymers, chlorinated polybutylenes, poly(1-hexenes), poly(1-octenes), poly(1-decenes), and the like and mixtures thereof; alkylbenzenes such as dodecylbenzenes, tetradecylbenzenes, dinonylbenzenes, di(2-ethylhexyl)-benzenes, and the like; polyphenyls such as biphenyls, terphenyls, alkylated polyphenyls, and the like; alkylated diphenyl ethers and alkylated diphenyl sulfides and the derivative, analogs and homologs thereof and the like.

Other useful synthetic lubricating oils include, but are not limited to, oils made by polymerizing olefins of less than 5 carbon atoms such as ethylene, propylene, butylenes, isobutene, pentene, and mixtures thereof. Methods of preparing such polymer oils are well known to those skilled in the art.

Additional useful synthetic hydrocarbon oils include liquid polymers of alpha olefins having the proper viscosity. Especially useful synthetic hydrocarbon oils are the hydrogenated liquid oligomers of $C_6$ to $C_{12}$ alpha olefins such as, for example, 1-decene trimer.

Another class of useful synthetic lubricating oils includes, but are not limited to, alkylene oxide polymers, i.e., homopolymers, interpolymers, and derivatives thereof where the terminal hydroxyl groups have been modified by, for example, esterification or etherification. These oils are exemplified by the oils prepared through polymerization of ethylene oxide or propylene oxide, the alkyl and phenyl ethers of these polyoxyalkylene polymers (e.g., methyl poly propylene glycol ether having an average molecular weight of 1,000, diphenyl ether of polyethylene glycol having a molecular weight of 500 to 1000, diethyl ether of polypropylene glycol having a molecular weight of 1,000 to 1,500, etc.) or mono- and polycarboxylic esters thereof such as, for example, the acetic esters, mixed $C_3$-$C_8$ fatty acid esters, or the $C_{13}$ oxo acid diester of tetraethylene glycol.

Yet another class of useful synthetic lubricating oils include, but are not limited to, the esters of dicarboxylic acids e.g., phthalic acid, succinic acid, alkyl succinic acids, alkenyl succinic acids, maleic acid, azelaic acid, suberic acid, sebacic acid, fumaric acid, adipic acid, linoleic acid dimer, malonic acids, alkyl malonic acids, alkenyl malonic acids, etc., with a variety of alcohols, e.g., butyl alcohol, hexyl alcohol, dodecyl alcohol, 2-ethylhexyl alcohol, ethylene glycol, diethylene glycol monoether, propylene glycol, etc. Specific examples of these esters include dibutyl adipate, di(2-ethylhexyl)sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethylhexanoic acid and the like.

Esters useful as synthetic oils also include, but are not limited to, those made from carboxylic acids having from about 5 to about 12 carbon atoms with alcohols, e.g., methanol, ethanol, etc., polyols and polyol ethers such as neopentyl glycol, trimethylol propane, pentaerythritol, dipentaerythritol, tripentaerythritol, and the like.

Silicon-based oils such as, for example, polyalkyl-, polyaryl-, polyalkoxy- or polyaryloxy-siloxane oils and silicate oils, comprise another useful class of synthetic lubricating oils. Specific examples of these include, but are not limited to, tetraethyl silicate, tetra-isopropyl silicate, tetra-(2-ethylhexyl) silicate, tetra-(4-methyl-hexyl)silicate, tetra-(p-tert-butylphenyl)silicate, hexyl-(4-methyl-2-pentoxy)disiloxane, poly(methyl)siloxanes, poly(methylphenyl)siloxanes, and the like.

The lubricating oil may be derived from unrefined, refined and rerefined oils, either natural, synthetic or mixtures of two or more of any of these of the type disclosed hereinabove. Unrefined oils are those obtained directly from a natural or synthetic source (e.g., coal, shale, or tar sands bitumen) without further purification or treatment. Examples of unrefined oils include, but are not limited to, a shale oil obtained directly from retorting operations, a petroleum oil obtained directly from distillation or an ester oil obtained directly from an esterification process, each of which is then used without further treatment. Refined oils are similar to the unrefined oils except they have been further treated in one or more purification steps to improve one or more properties. These purification techniques are known to those of skill in the art and include, for example, solvent extractions, secondary distillation, acid or base extraction, filtration, percolation, hydrotreating, dewaxing, etc. Rerefined oils are obtained by treating used oils in processes similar to those used to obtain refined oils. Such rerefined oils are also known as reclaimed or reprocessed oils and often are additionally processed by techniques directed to removal of spent additives and oil breakdown products.

Lubricating oil base stocks derived from the hydroisomerization of wax may also be used, either alone or in combination with the aforesaid natural and/or synthetic base stocks. Such wax isomerate oil is produced by the hydroisomerization of natural or synthetic waxes or mixtures thereof over a hydroisomerization catalyst.

Natural waxes are typically the slack waxes recovered by the solvent dewaxing of mineral oils; synthetic waxes are typically the wax produced by the Fischer-Tropsch process.

The lubricating oil composition of the present invention will also contain one or more non-halogen-containing oil-soluble titanium complexes comprising at least one ligand comprising an anion of a carboxylic acid. In general, the non-halogen-containing oil-soluble titanium complex will contain a titanium core and bonded thereto at least one ligand comprising an anion of a carboxylic acid. In one embodiment, the non-halogen-containing oil-soluble titanium complex will contain a titanium core and bonded thereto at least two ligands comprising the same or different anion of a carboxylic acid. In another embodiment, the non-halogen-containing oil-soluble titanium complex will contain a titanium core and bonded thereto at least three ligands comprising the same or different anion of carboxylic acid. In yet another embodiment, the non-halogen-containing oil-soluble titanium complex will contain a titanium core and bonded thereto four ligands comprising the same or different anion of a carboxylic acid.

In one embodiment, the ligands comprising an anion of a carboxylic acid, also referred to as a carboxylate group, are derived from a monocarboxylic acid or acid anhydride. In one embodiment, useful monocarboxylic acids include fatty acids. In another embodiment, useful monocarboxylic acids include $C_2$ to $C_{30}$ monocarboxylic acids. In another embodiment, useful monocarboxylic acids include $C_5$ to $C_{25}$ monocarboxylic acids. In yet another embodiment, useful monocarboxylic acids include $C_{12}$ to $C_{22}$ monocarboxylic acids. The monocarboxylic acids can be saturated or unsaturated, linear, branched or cyclic aliphatic monocarboxylic acids, aromatic monocarboxylic acids or mixture thereof. The monocarboxylic acid itself can be derived from natural, i.e., plant or animal, sources. Representative examples of monocarboxylic acids include, but are not limited to, caproic acid, caprylic acid, capric acid, lauric acid, myristic acid, palmitic acid, stearic acid, arachidic acid, oleic acid, linoleic acid, linolenic acid, cyclohexanecarboxylic acid, phenylacetic acid, benzoic acid, neodecanoic acid, and mixtures of any of the foregoing.

In one embodiment, one or more of the ligands comprising an anion of a carboxylic acid are derived from a $C_4$ to $C_{30}$ dicarboxylic acid or acid anhydride. Representative examples of dicarboxylic acids include alkyl and alkenyl succinic acids and the like.

The one or more non-halogen-containing oil-soluble titanium complexes disclosed herein are known in the art and commercially available from such sources as Gelest, Inc. or can be readily prepared by methods known in the art, e.g., as disclosed U.S. Pat. No. 5,260,466, the contents of which are incorporated herein by reference. For example, the one or more non-halogen-containing oil-soluble titanium complexes described herein can be obtained by a reaction product of a titanium alkoxide and a $C_2$ to $C_{30}$ monocarboxylic acid. The reaction product may be represented by the following formula:

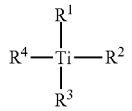

(I)

wherein $R^1$, $R^2$, $R^3$ and $R^4$ are independently a $C_1$ to $C_{20}$ alkoxy group and preferably independently a $C_3$ to $C_8$ alkoxy group or a $C_2$ to $C_{30}$ monocarboxylic acid anion group or a $C_2$ to $C_{30}$ dicarboxylic acid anion group, wherein at least one of $R^1$, $R^2$, $R^3$ and $R^4$ is a $C_2$ to $C_{30}$ monocarboxylic acid anion group. In one embodiment, at least two of $R^1$, $R^2$, $R^3$ and $R^4$ are independently a $C_2$ to $C_{30}$ carboxylic acid anion group. In another embodiment, at least three of $R^1$, $R^2$, $R^3$ and $R^4$ are independently a $C_2$ to $C_{30}$ monocarboxylic acid anion group. In yet another embodiment, each of $R^1$, $R^2$, $R^3$ and $R^4$ are independently a $C_2$ to $C_{30}$ monocarboxylic acid anion group.

Representative examples of $C_1$ to $C_{20}$ alkoxy groups for use herein include, by way of example, an alkyl group as defined herein attached via oxygen linkage to the rest of the molecule, i.e., of the general Formula —$OR^5$, wherein $R^5$ is a $C_1$ to $C_{20}$ alkyl, $C_3$ to $C_{20}$ cycloalkyl, $C_3$ to $C_{20}$ cycloalkylalkyl, $C_3$ to $C_{20}$ cycloalkenyl, $C_5$ to $C_{20}$ aryl or $C_5$ to $C_{20}$ arylalkyl as defined herein, e.g., —$OCH_3$, —$OC_2H_5$, or —$OC_6H_5$, and the like.

Representative examples of $C_2$ to $C_{30}$ carboxylic acid anion groups for use herein include, by way of example, a carboxylic acid group as defined herein attached via oxygen linkage to the rest of the molecule, i.e., of the general formula

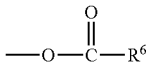

wherein $R^6$ is a $C_2$ to $C_{30}$ hydrocarbyl group. In one embodiment, $R^6$ is a $C_5$ to $C_{25}$ hydrocarbyl group. In one embodiment, $R^6$ is a $C_{12}$ to $C_{22}$ hydrocarbyl group. Representative examples of hydrocarbyl groups include, but are not limited to, substituted or unsubstituted alkyl or alkenyl groups, substituted or unsubstituted cycloalkyl, cycloalkenyl or cycloalkylalkyl groups and substituted or unsubstituted aryl or arylalkyl groups.

Representative examples of substituted or unsubstituted alkyl groups for use herein include, by way of example, a straight or branched alkyl chain radical containing carbon and hydrogen atoms of from 1 to about 20 carbon atoms and preferably from 1 to about 8 carbon atoms, e.g., methyl, ethyl, n-propyl, isopropyl, n-butyl, n-pentyl, etc., and the like.

Representative examples of substituted or unsubstituted alkenyl groups for use herein include, by way of example, a straight or branched alkyl chain radical containing carbon and hydrogen atoms of from 1 to about 20 carbon atoms and preferably from 1 to about 8 carbon atoms with at least one carbon-carbon double bond, e.g., methylene, ethylene, n-propylene, etc., and the like.

Representative examples of substituted or unsubstituted cycloalkyl groups for use herein include, by way of example, a substituted or unsubstituted non-aromatic mono or multicyclic ring system of about 3 to about 20 carbon atoms such as, for example, cyclopropyl, cyclobutyl, cyclopentyl, cyclohexyl, bridged cyclic groups or sprirobicyclic groups, e.g., spiro-(4, 4)-non-2-yl and the like, optionally containing one or more heteroatoms, e.g., O and N, and the like.

Representative examples of substituted or unsubstituted cycloalkylalkyl groups for use herein include, by way of example, a substituted or unsubstituted cyclic ring-containing radical containing from about 3 to about 20 carbon atoms directly attached to the alkyl group which are then attached to the main structure of the monomer at any carbon from the alkyl group that results in the creation of a stable structure such as, for example, cyclopropylmethyl, cyclobutylethyl, cyclopentylethyl and the like, wherein the cyclic ring can optionally contain one or more heteroatoms, e.g., O and N, and the like.

Representative examples of substituted or unsubstituted cycloalkenyl groups for use herein include, by way of example, a substituted or unsubstituted cyclic ring-containing radical containing from about 3 to about 20 carbon atoms with at least one carbon-carbon double bond such as, for example, cyclopropenyl, cyclobutenyl, cyclopentenyl and the like, wherein the cyclic ring can optionally contain one or more heteroatoms, e.g., O and N, and the like.

Representative examples of substituted or unsubstituted aryl groups for use herein include, by way of example, a substituted or unsubstituted monoaromatic or polyaromatic radical containing from about 5 to about 20 carbon atoms such as, for example, phenyl, naphthyl, tetrahydronapthyl, indenyl, biphenyl and the like, optionally containing one or more heteroatoms, e.g., O and N, and the like.

Representative examples of substituted or unsubstituted arylalkyl groups for use herein include, by way of example, a substituted or unsubstituted aryl group as defined herein directly bonded to an alkyl group as defined herein, e.g., $—CH_2C_6CH_5$, $—C_2H_5C_6H_5$ and the like, wherein the aryl group can optionally contain one or more heteroatoms, e.g., O and N, and the like.

The substituents in the 'substituted alkyl', 'substituted cycloalkyl', 'substituted cycloalkylalkyl', 'substituted cycloalkenyl', 'substituted aryl', and 'substituted arylalkyl' may be the same or different and include one or more substituents such as hydrogen, hydroxy, halogen, carboxyl, cyano, nitro, oxo (=O), thio(=S), substituted or unsubstituted alkyl, substituted or unsubstituted alkoxy, substituted or unsubstituted alkenyl, substituted or unsubstituted alkynyl, substituted or unsubstituted aryl, substituted or unsubstituted arylalkyl, substituted or unsubstituted cycloalkyl, substituted or unsubstituted cycloalkenyl, substituted or unsubstituted amino, substituted or unsubstituted aryl, substituted or unsubstituted heteroaryl, substituted heterocycloalkyl ring, substituted or unsubstituted heteroarylalkyl, substituted or unsubstituted heterocyclic ring, substituted or unsubstituted guanidine, $—COOR_x$, $—C(O)R_x$, $—C(S)R_x$, $—C(O)NR_xR_y$, $—C(O)ONR_xR_y$, $—NR_xCONR_yR_y$, $—N(R_x)SOR_y$, $—N(R_x)SO_2R_y$, $—(=N—N(R_x)R_y)$, $—NR_xC(O)OR_y$, $—NR_xR_y$, $—NR_xC(O)R_y—$, $—NR_xC(S)R_y—NR_xC(S)NR_yR_x$, $—SONR_xR_y—$, $—SO_2NR_xR_y—$, $—OR_x$, $—OR_xC(O)NR_yR_x$, $—OR_xC(O)OR_y—$, $—OC(O)R_x$, $—OC(O)NR_xR_y$, $—R_xNR_yC(O)R_z$, $—R_xOR_y$, $—R_xC(O)OR_y$, $—R_xC(O)NR_yR_z$, $—R_xC(O)R_x$, $—R_xOC(O)R_y$, $—SR_x$, $—SOR_x$, $—SO_2R_x$, $—ONO_2$, wherein $R_x$, $R_y$ and $R_z$ in each of the above groups can be the same or different and can be a hydrogen atom, substituted or unsubstituted alkyl, substituted or unsubstituted alkoxy, substituted or unsubstituted alkenyl, substituted or unsubstituted alkynyl, substituted or unsubstituted aryl, substituted or unsubstituted arylalkyl, substituted or unsubstituted cycloalkyl, substituted or unsubstituted cycloalkenyl, substituted or unsubstituted amino, substituted or unsubstituted aryl, substituted or unsubstituted heteroaryl, 'substituted heterocycloalkyl ring' substituted or unsubstituted heteroarylalkyl, or a substituted or unsubstituted heterocyclic ring.

Representative examples of alkoxide groups include methoxide, ethoxide, propoxide, isopropoxide, butoxide, 2-ethylhexoxide, isobutoxide, 4-methyl-2-pentoxide, hexoxide, pentoxide, isopentoxide, 2-[N,N-(2-hydroxyethyl)-amino]-ethoxide and the like and mixtures thereof:

The one or more non-halogen-containing oil-soluble titanium complexes advantageously provide excellent antiwear protection when incorporated into a lubricating oil composition which is free of any zinc dialkyldithiophosphate. Generally, the amount of the one or more non-halogen-containing oil-soluble titanium complexes in the lubricating oil composition will range from about 10 parts per million (ppm) to about 3000 ppm as Ti metal, based on the total weight of the lubricating oil composition. In one embodiment, the amount of the one or more non-halogen-containing oil-soluble titanium complexes in the lubricating oil composition will range from about 50 to about 2500 ppm as Ti metal, based on the total weight of the lubricating oil composition. In one embodiment, the amount of the one or more non-halogen-containing oil-soluble titanium complexes in the lubricating oil composition will range from about 300 to about 2000 ppm as Ti metal, based on the total weight of the lubricating oil composition. In one embodiment, the amount of the one or more non-halogen-containing oil-soluble titanium complexes in the lubricating oil composition will range from about 600 to about 1800 ppm, based on the total weight of the lubricating oil composition. In one embodiment, the amount of the one or more non-halogen-containing oil-soluble titanium complexes in the lubricating oil composition is about 1600 ppm, based on the total weight of the lubricating oil composition.

The titanium complexes of this invention, as well as other additives useful in the invention, may be provided as an additive package or as a concentrate in which the complex or additive is incorporated into a substantially inert, normally liquid organic diluent such as, for example, mineral oil, naphtha, benzene, toluene or xylene to form an additive concentrate. These concentrates usually contain from about 20% to about 80% by weight of such diluent. Typically, a neutral oil having a viscosity of about 4 to about 8.5 cSt at 100° C. and preferably about 4 to about 6 cSt at 100° C. will be used as the diluent. However, synthetic oils, as well as other organic liquids which are compatible with the additives and finished lubricating oil, can also be used.

The lubricating oil compositions of the present invention will further contain one or more dispersants. The one or more dispersants employed in the lubricating oil compositions can be any dispersant known to one skilled in the art. Suitable dispersants include one or more ashless dispersant compounds and are generally used to maintain in suspension insoluble materials resulting from oxidation during use, thus preventing sludge flocculation and precipitation or deposition on metal parts. An ashless dispersant generally comprises an oil soluble polymeric hydrocarbon backbone having functional groups that are capable of associating with particles to be dispersed. Many types of ashless dispersants are known in the art.

Representative examples of ashless dispersants include, but are not limited to, amines, alcohols, amides, or ester polar moieties attached to the polymer backbones via bridging groups. An ashless dispersant of the present invention may be, for example, selected from oil soluble salts, esters, amino-esters, amides, imides, and oxazolines of long chain hydrocarbon substituted mono and dicarboxylic acids or their anhydrides; thiocarboxylate derivatives of long chain hydrocarbons, long chain aliphatic hydrocarbons having a polyamine attached directly thereto, and Mannich condensation products formed by condensing a long chain substituted phenol with formaldehyde and polyalkylene polyamine.

Carboxylic dispersants are reaction products of carboxylic acylating agents (acids, anhydrides, esters, etc.) comprising at least about 34 and preferably at least about 54 carbon atoms with nitrogen containing compounds (such as amines), organic hydroxy compounds (such as aliphatic compounds including monohydric and polyhydric alcohols, or aromatic compounds including phenols and naphthols), and/or basic inorganic materials. These reaction products include imides, amides, and esters.

Succinimide dispersants are a type of carboxylic dispersant. They are produced by reacting hydrocarbyl-substituted succinic acylating agent with organic hydroxy compounds, or with amines comprising at least one hydrogen atom attached to a nitrogen atom, or with a mixture of the hydroxy compounds and amines. The term "succinic acylating agent" refers to a hydrocarbon-substituted succinic acid or a succinic acid-producing compound, the latter encompasses the acid itself. Such materials typically include hydrocarbyl-substituted succinic acids, anhydrides, esters (including half esters) and halides.

Succinic-based dispersants have a wide variety of chemical structures. One class of succinic-based dispersants may be represented by the formula:

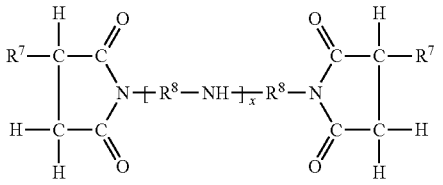

wherein each $R^7$ is independently a hydrocarbyl group, such as a polyolefin-derived group. Typically the hydrocarbyl group is an alkyl group, such as a polyisobutyl group. Alternatively expressed, the $R^7$ groups can contain about 40 to about 500 carbon atoms, and these atoms may be present in aliphatic forms. $R^8$ is an alkylene group, commonly an ethylene ($C_2H_4$) group. Examples of succinimide dispersants include those described in, for example, U.S. Pat. Nos. 3,172,892, 4,234,435 and 6,165,235.

The polyalkenes from which the substituent groups are derived are typically homopolymers and interpolymers of polymerizable olefin monomers of 2 to about 16 carbon atoms, and usually 2 to 6 carbon atoms. The amines which are reacted with the succinic acylating agents to form the carboxylic dispersant composition can be monoamines or polyamines.

Succinimide dispersants are referred to as such since they normally contain nitrogen largely in the form of imide functionality, although the amide functionality may be in the form of amine salts, amides, imidazolines as well as mixtures thereof. To prepare a succinimide dispersant, one or more succinic acid-producing compounds and one or more amines are heated and typically water is removed, optionally in the presence of a substantially inert organic liquid solvent/diluent. The reaction temperature can range from about 80° C. up to the decomposition temperature of the mixture or the product, e.g., between about 100° C. to about 300° C. Additional details and examples of procedures for preparing the succinimide dispersants of the present invention include those described in, for example, U.S. Pat. Nos. 3,172,892, 3,219,666, 3,272,746, 4,234,435, 6,165,235 and 6,440,905.

Suitable ashless dispersants may also include amine dispersants, which are reaction products of relatively high molecular weight aliphatic halides and amines, preferably polyalkylene polyamines. Examples of such amine dispersants include those described in, for example, U.S. Pat. Nos. 3,275,554, 3,438,757, 3,454,555 and 3,565,804.

Suitable ashless dispersants may further include "Mannich dispersants," which are reaction products of alkyl phenols in which the alkyl group contains at least about 30 carbon atoms with aldehydes (especially formaldehyde) and amines (especially polyalkylene polyamines). Examples of such dispersants include those described in, for example, U.S. Pat. Nos. 3,036,003, 3,586,629, 3,591,598 and 3,980.569.

Nitrogen-containing ashless (metal-free) dispersants are basic, and contribute to the TBN of a lubricating oil composition to which they are added, without introducing additional sulfated ash.

Suitable ashless dispersants may also be post-treated ashless dispersants such as post-treated succinimides, e.g., post-treatment processes involving borate or ethylene carbonate as disclosed in, for example, U.S. Pat. Nos. 4,612,132 and 4,746,446; and the like as well as other post-treatment processes. The carbonate-treated alkenyl succinimide is a polybutene succinimide derived from polybutenes having a molecular weight of about 450 to about 3000, preferably from about 900 to about 2500, more preferably from about 1300 to about 2400, and most preferably from about 2000 to about 2400, as well as mixtures of these molecular weights. Preferably, it is prepared by reacting, under reactive conditions, a mixture of a polybutene succinic acid derivative, an unsaturated acidic reagent copolymer of an unsaturated acidic reagent and an olefin, and a polyamine, such as disclosed in U.S. Pat. No. 5,716,912, the contents of which are incorporated herein by reference.

Suitable ashless dispersants may also be polymeric, which are interpolymers of oil-solubilizing monomers such as decyl methacrylate, vinyl decyl ether and high molecular weight olefins with monomers containing polar substitutes. Examples of polymeric dispersants include those described in, for example, U.S. Pat. Nos. 3,329,658; 3,449,250 and 3,666,730.

In one preferred embodiment of the present invention, an ashless dispersant for use in the lubricating oil composition is a bis-succinimide derived from a polyisobutenyl group having a number average molecular weight of about 700 to about 2300. The dispersant(s) for use in the lubricating oil compositions of the present invention are preferably non-polymeric (e.g., are mono- or bis-succinimides).

Generally, the one or more dispersants are present in the lubricating oil composition in an amount ranging from about 0.5 to about 8 wt. %, based on the total weight of the lubricating oil composition. In one embodiment, the one or more dispersants are present in the lubricating oil composition in an amount ranging from about 1 to about 5 wt. %, based on the total weight of the lubricating oil composition.

The lubricating oil compositions of the present invention will further contain one or more detergents. The detergents employed in the lubricating oil compositions can be any detergent known to one skilled in the art. Suitable detergents include one or more metal-containing detergent compounds and generally function both as a detergent to reduce or remove deposits and as an acid neutralizer or rust inhibitor, thereby reducing wear and corrosion and extending engine life. Detergents generally comprise a polar head with long hydrophobic tail, with the polar head comprising a metal salt of an acid organic compound.

The lubricating oil composition according to the present invention may contain one or more detergents, which are normally salts, and especially overbased salts. Overbased salts, or overbased materials, are single phase, homogeneous Newtonian systems characterized by a metal content in excess of that which would be present according to the stoichiometry of the metal and the particular acidic organic compound reacted with the metal. The overbased materials are prepared by reacting an acidic material (typically an inorganic acid or lower carboxylic acid such as carbon dioxide) with a mixture comprising an acidic organic compound, in a reaction medium comprising at least one inert, organic solvent (such as mineral oil, naphtha, toluene, xylene) in the presence of a stoichiometric excess of a metal base and a promoter.

Useful acidic organic compounds for making the detergents include carboxylic acids, sulfonic acids, phosphorus-containing acids, phenols and mixtures thereof. Preferably, the acidic organic compounds are carboxylic acids or sulfonic acids and hydrocarbyl-substituted salicylic acids.

Carboxylate detergents, e.g., salicylates, can be prepared by reacting an aromatic carboxylic acid with an appropriate metal compound such as an oxide or hydroxide. Neutral or overbased products may then be obtained by methods well known in the art. The aromatic moiety of the aromatic carboxylic acid can contain one or more heteroatoms such as nitrogen and oxygen. Preferably, the moiety contains only carbon atoms. More preferably, the moiety contains six or more carbon atoms, such as a benzene moiety. The aromatic carboxylic acid may contain one or more aromatic moieties, such as one or more benzene rings, optionally fused together or otherwise connected via alkylene bridges. Representative examples of aromatic carboxylic acids include salicylic acids and sulfurized derivatives thereof such as hydrocarbyl substituted salicylic acid and derivatives thereof. Processes for sulfurizing, for example, a hydrocarbyl-substituted salicylic acid, are known to those skilled in the art. Salicylic acids are typically prepared by carboxylation, for example, by the Kolbe-Schmitt process, of phenoxides. In that case, salicylic acids are generally obtained in a diluent in admixture with an uncarboxylated phenol.

Metal salts of phenols and sulfurized phenols are prepared by reaction with an appropriate metal compound such as an oxide or hydroxide. Neutral or overbased products may be obtained by methods well known in the art. For example, sulfurized phenols may be prepared by reacting a phenol with sulfur or a sulfur-containing compound such as hydrogen sulfide, sulfur monohalide or sulfur dihalide, to form products that are mixtures of compounds in which 2 or more phenols are bridged by sulfur-containing bridges.

The metal compounds useful in making the overbased salts are generally any Group I or Group II metal compounds in the Periodic Table of the Elements. Preferably, the metal compounds are Group II metals and include Group IIa alkaline earth metals (e.g., magnesium, calcium, strontium, barium) as well as Group IIb metals such as zinc or cadmium. Preferably, the Group II metals are magnesium, calcium, barium, or zinc, more preferably magnesium or calcium, and most preferably calcium. Examples of the overbased detergents include, but are not limited to, calcium sulfonates, calcium phenates, calcium salicylates, calcium stearates and mixtures thereof.

Detergent concentrates suitable for use in the lubricating oil compositions of the present invention may be low overbased, e.g., an overbased detergent concentrate having a BN below about 100. The BN of such a low-overbased detergent concentrate may be from about 5 to about 50, or from about 10 to about 30, or from about 15 to about 20. Alternatively, the detergent concentrates suitable for use in the lubricating oil compositions of the present invention may be high overbased (e.g., an overbased detergent concentrate having a BN above about 100). The BN of such a high-overbased detergent concentrate may be from about 100 to about 450, or from about 200 to about 350, or from about 250 to about 280. A low-overbased calcium sulfonate detergent concentrate with a BN of about 17 and a high-overbased sulfurized calcium phenate concentrate with a BN of about 120 are two exemplary overbased detergent concentrates for use in the lubricating oil compositions of the present invention.

The lubricating oil compositions of the present invention may contain more than one detergent concentrate, which may be all low-BN detergent concentrates, all high-BN detergent concentrates, or a mixture thereof. For example, the lubricating oil compositions of the present invention may contain a first metal-containing detergent concentrate which is an overbased alkaline earth metal sulfonate or phenate detergent concentrate having a BN of about 100 to about 450 and a second metal-containing detergent concentrate which is an overbased alkaline earth metal sulfonate or phenate detergent concentrate having a BN of about 10 to about 50.

Suitable detergents for use in the lubricating oil compositions also include "hybrid" detergents such as, for example, phenate/salicylates, sulfonate/phenates, sulfonate/salicylates, sulfonates/phenates/salicylates, and the like. Examples of hybrid detergents include those described in, for example, U.S. Pat. Nos. 6,153,565, 6,281,179, 6,429,178, and 6,429,179.

Generally, the one or more detergents are present in the lubricating oil composition in an amount ranging from about 0.5 to about 8 wt. %, based on the total weight of the lubricating oil composition. In one embodiment, the one or more detergents are present in the lubricating oil composition in an amount ranging from about 1 to about 5 wt. %, based on the total weight of the lubricating oil composition. Where two metal-containing detergents are employed, the first metal-containing detergent is present in the lubricating oil composition in an amount ranging from about 0.2 to about 5 wt. %, and the second metal-containing detergent is present in the lubricating oil composition in an amount ranging from about 0.2 to about 5 wt. %, based on the total weight of the lubricating oil composition.

The lubricating oil compositions of the present invention may also contain other conventional additives for imparting auxiliary functions to give a finished lubricating oil composition in which these additives are dispersed or dissolved. For example, the lubricating oil compositions can be blended with antioxidants, anti-wear agents other than zinc dialkyldithiophosphate, rust inhibitors, dehazing agents, demulsifying agents, metal deactivating agents, friction modifiers, pour point depressants, antifoaming agents, co-solvents, package compatibilisers, corrosion-inhibitors, dyes, extreme pressure agents and the like and mixtures thereof. A variety of the additives are known and commercially available. These additives, or their analogous compounds, can be employed for the preparation of the lubricating oil compositions of the invention by the usual blending procedures.

Examples of an antioxidant include, but are not limited to, aminic types, e.g., diphenylamine, phenyl-alpha-napthylamine, N,N-di(alkylphenyl)amines; and alkylated phenylene-diamines; phenolics such as, for example, BHT, sterically hindered alkyl phenols such as 2,6-di-tert-butylphenol, 2,6-di-tert-butyl-p-cresol and 2,6-di-tert-butyl-4-(2-octyl-3-propanoic) phenol; and mixtures thereof.

Examples of a rust inhibitor include, but are not limited to, nonionic polyoxyalkylene agents, e.g., polyoxyethylene lauryl ether, polyoxyethylene higher alcohol ether, polyoxyethylene nonylphenyl ether, polyoxyethylene octylphenyl ether, polyoxyethylene octyl stearyl ether, polyoxyethylene oleyl ether, polyoxyethylene sorbitol monostearate, polyoxyethylene sorbitol monooleate, and polyethylene glycol monooleate; stearic acid and other fatty acids; dicarboxylic acids; metal soaps; fatty acid amine salts; metal salts of heavy sulfonic acid; partial carboxylic acid ester of polyhydric alcohol; phosphoric esters; (short-chain) alkenyl succinic acids; partial esters thereof and nitrogen-containing derivatives thereof; synthetic alkarylsulfonates, e.g., metal dinonylnaphthalene sulfonates; and the like and mixtures thereof.

Examples of a friction modifier include, but are not limited to, alkoxylated fatty amines; borated fatty epoxides; fatty phosphites, fatty epoxides, fatty amines, borated alkoxylated fatty amines, metal salts of fatty acids, fatty acid amides, glycerol esters, borated glycerol esters; and fatty imidazolines as disclosed in U.S. Pat. No. 6,372,696, the contents of which are incorporated by reference herein; friction modifiers obtained from a reaction product of a $C_4$ to $C_{75}$, preferably a $C_6$ to $C_{24}$, and most preferably a $C_6$ to $C_{20}$, fatty acid ester and a nitrogen-containing compound selected from the group consisting of ammonia, and an alkanolamine and the like and mixtures thereof.

Examples of an antifoaming agent include, but are not limited to, polymers of alkyl methacrylate; polymers of dimethylsilicone and the like and mixtures thereof.

Examples of a pour point depressant include, but are not limited to, polymethacrylates, alkyl acrylate polymers, alkyl methacrylate polymers, di(tetra-paraffin phenol)phthalate, condensates of tetra-paraffin phenol, condensates of a chlorinated paraffin with naphthalene and combinations thereof. In one embodiment, a pour point depressant comprises an ethylene-vinyl acetate copolymer, a condensate of chlorinated paraffin and phenol, polyalkyl styrene and the like and combinations thereof. The amount of the pour point depressant may vary from about 0.01 wt. % to about 10 wt. %.

Examples of a demulsifier include, but are not limited to, anionic surfactants (e.g., alkyl-naphthalene sulfonates, alkyl benzene sulfonates and the like), nonionic alkoxylated alkylphenol resins, polymers of alkylene oxides (e.g., polyethylene oxide, polypropylene oxide, block copolymers of ethylene oxide, propylene oxide and the like), esters of oil soluble acids, polyoxyethylene sorbitan ester and the like and combinations thereof. The amount of the demulsifier may vary from about 0.01 wt. % to about 10 wt. %.

Examples of a corrosion inhibitor include, but are not limited to, half esters or amides of dodecylsuccinic acid, phosphate esters, thiophosphates, alkyl imidazolines, sarcosines and the like and combinations thereof. The amount of the corrosion inhibitor may vary from about 0.01 wt. % to about 5 wt. %.

Examples of an extreme pressure agent include, but are not limited to, sulfurized animal or vegetable fats or oils, sulfurized animal or vegetable fatty acid esters, fully or partially esterified esters of trivalent or pentavalent acids of phosphorus, sulfurized olefins, dihydrocarbyl polysulfides, sulfurized Diels-Alder adducts, sulfurized dicyclopentadiene, sulfurized or co-sulfurized mixtures of fatty acid esters and monounsaturated olefins, co-sulfurized blends of fatty acid, fatty acid ester and alpha-olefin, functionally-substituted dihydrocarbyl polysulfides, thia-aldehydes, thia-ketones, epithio compounds, sulfur-containing acetal derivatives, co-sulfurized blends of terpene and acyclic olefins, and polysulfide olefin products, amine salts of phosphoric acid esters or thiophosphoric acid esters and the like and combinations thereof. The amount of the extreme pressure agent may vary from about 0.01 wt. % to about 5 wt. %.

Each of the foregoing additives, when used, is used at a functionally effective amount to impart the desired properties to the lubricant. Thus, for example, if an additive is a friction modifier, a functionally effective amount of this friction modifier would be an amount sufficient to impart the desired friction modifying characteristics to the lubricant. Generally, the concentration of each of these additives, when used, ranges from about 0.001% to about 20% by weight, and in one embodiment about 0.01% to about 10% by weight based on the total weight of the lubricating oil composition.

The final application of the lubricating oil compositions of this invention may be, for example, in marine cylinder lubricants in crosshead diesel engines, crankcase lubricants in automobiles and railroads and the like, lubricants for heavy machinery such as steel mills and the like, or as greases for bearings and the like. In one embodiment, the lubricating oil compositions of this invention are used to lubricate an internal combustion engine such as a spark ignition engine, or a compression ignition diesel engine, e.g., a heavy duty diesel engine or a compression ignition diesel engine equipped with at least one of an exhaust gas recirculation (EGR) system, a catalytic converter, and a particulate trap.

Whether the lubricating oil composition is fluid or solid will ordinarily depend on whether a thickening agent is present. Typical thickening agents include polyurea acetates, lithium stearate and the like.

In another embodiment of the invention, the one or more non-halogen-containing oil-soluble titanium complexes disclosed herein may be provided as an additive package. The additive package will also typically contain one or more of the various other additives and diluent, referred to above, in the desired amounts and ratios to facilitate direct combination with the requisite amount of base oil.

The following non-limiting examples are illustrative of the present invention.

Comparative Example A

A baseline automotive engine oil without zinc dialkyldithiophosphate was formed containing approximately 80 wt. % of a 7:1 mixture of Chevron 220N and Chevron 600N Group II base oil, 8.1 wt. % of a mixture of oil concentrates of polyisobutylene succinimide dispersants, 2.2 wt. % of a mixture of oil concentrates of high and low BN detergents, a molybdenum inhibitor, a mixture of amine and phenolic antioxidants, an ethylene-propylene copolymer viscosity index improver and foam inhibitor. In the following examples, titanium compounds were added in at approximately 1600 ppm Ti in the finished lubricant.

The resulting baseline lubricating oil formulation had a sulfated ash content of 0.63 wt. % as determined by ASTM D874, a phosphorus content of 0 wt. % and a sulfur content of 0.16 wt. %.

Example 1

A baseline lubricating oil formulation was formed containing the same additives, base oil and treat rate, as in Comparative Example A. Titanium dioleate-isopropoxide, prepared by the following method, was formulated into this baseline lubricating oil formulation at 2.4 wt. %. An overhead stirrer, a temperature probe, and a condenser equipped with dean stark trap were connected to a 250 mL 4 neck round bottom flask. Oleic acid (79.44 g, 0.281 mol) was charged into the reactor and allowed to stir at room temperature in the presence of nitrogen sweep. Titanium isopropoxide (39.97 g, 0.0140 mol) was then charged dropwise using a dropping funnel, while the reaction changed gradually from colorless to dark yellow. Reaction was then allowed to heat up to 140° C. and hold for 2 hours. Vacuum was then applied at 50 mmHg for another 2 hours. Titanium in the final product was measured to be 6.57 wt %.

The resulting lubricating oil composition had a sulfated ash content of 0.88 wt. % as determined by ASTM D874, a phosphorus content of 0 wt. % and a sulfur content of 0.15 wt. %.

Example 2

A baseline lubricating oil formulation was formed containing the same additives, base oil and treat rate, as in Comparative Example A. Titanium (IV) triisostearyl-isopropoxide prepared in a manner similar to the process disclosed in Example 1 was formulated into this baseline lubricating oil formulation at 3.1 wt. %.

The resulting lubricating oil composition had a sulfated ash content of 0.88 wt. % as determined by ASTM D874, a phosphorus content of 0 wt. % and a sulfur content of 0.15 wt. %.

Comparative Example B

A baseline lubricating oil formulation was formed containing the same additives, base oil and treat rate, as in Comparative Example A. Titanium (IV) isopropoxide was formulated into this baseline lubricating oil formulation at 1 wt. %.

The resulting lubricating oil composition had a sulfated ash content of 0.92 wt. % as determined by ASTM D874, a phosphorus content of 0 wt. % and a sulfur content of 0.15 wt. %.

Comparative Example C

A baseline lubricating oil formulation was formed containing the same additives, base oil and treat rate, as in Comparative Example A. A secondary ZnDTP was formulated into this baseline lubricating oil formulation at 19 millimoles Zn/kg lubricating oil.

The resulting lubricating oil composition had a sulfated ash content of 0.93 wt. % as determined by ASTM D874, a phosphorus content of 0.13 wt. % and a sulfur content of 0.48 wt. %.

Performance Testing

The wear-preventing properties of the lubricating oil compositions of Examples 1 and 2 and the lubricating oil compositions of Comparative Examples A-C were evaluated using Chevron modified PCS MTM bench test as per "Soot Wear in Diesel Engines," E. S. Yamaguchi, M. Untermann, S. H. Roby, P. R. Ryason, and S. W. Yeh., J. Engineering Tribology 220(J5), August 2006. In this test, a fixed metal ball is rubbed against a rotating metal disk that is lubricated with test oil loaded with engine soot engine soot. A wear scar is formed on the fixed metal ball. The diameter of the wear scar is measured and reported. Low wear scars are believed to be representative of oils that have excellent wear-preventing properties.

Test oils were prepared by mixing the test lubricant with 9 wt-% of engine soot. Soot was mixed with test lubricant in a homogenizer. Engine soot obtained from the overhead recovery system of an engine testing facility was used for this test. The soot was made into a slurry with pentane, filtered through a sintered glass funnel, dried in a vacuum oven under an nitrogen atmosphere and ground to 50 mesh (300 μm) maximum before addition to the test lubricant. The objective of this action was to make reproducible particles that would give rise to abrasive wear as seen in modern EGR engines.

The PCS MTM instrument was modified so that a ¼-in. diameter Falex 52100 steel test ball (with special holder) was substituted for the pin holder that came with the instrument [See, e.g., Yamaguchi, E. S., "Friction and Wear Measurements Using a Modified MTM Tribometer," IP.com Journal 7, Vol. 2, 9, pp 57-58 (August 2002). No. IPCOM000009117D]. The instrument was used in the pin-on-disk mode and run under sliding conditions. It is achieved by fixing the ball rigidly in the special holder, such that the ball has only one degree of freedom, to slide on the disk. The conditions are shown in Table 1.

TABLE 1

Test Conditions for MTM

| | | |
|---|---|---|
| Load | 14 N | |
| Initial Contact Pressure | 1.53 GPa | |
| Temperature | 116° C. | |
| Tribocouple | 52100/52100 | |
| | mm/s | min |
| Speed | 3800 | 10 |
| | 2000 | 10 |
| | 1000 | 10 |
| | 100 | 10 |
| | 20 | 10 |
| | 10 | 10 |
| | 5 | 10 |
| Length of Time | 70 min | |
| Diesel Engine Soot | 9% | |

To prepare the test specimens, the anti-corrosion coating of the PCS Instruments 52100 smooth (0.02 micron Ra), steel discs was removed using heptane, hexane, and isooctane. Then, the discs were wiped clean with a soft tissue and submersed in a beaker of the cleaning solvent until the film on the disc track had been removed, and the track of the disc appeared shiny. The discs and test balls were placed in individual containers and submerged in Chevron 450 thinner. Lastly, the test specimens were ultrasonically cleaned by placing them in a sonicator for 20 minutes. Results for the Chevron modified PCS wear tests are shown in Table 2.

TABLE 2

| Ex./Comp. Ex. | WSD (μm) |
|---|---|
| Example 1 | 294 |
| Example 2 | 323 |
| Comparative Ex. A | 549 |
| Comparative Ex. B | 345 |
| Comparative Ex. C | 378 |

It is clear that the lubricating oil compositions of the present invention result in improved wear performance.

It will be understood that various modifications may be made to the embodiments disclosed herein. Therefore the above description should not be construed as limiting, but merely as exemplifications of preferred embodiments. For example, the functions described above and implemented as the best mode for operating the present invention are for illustration purposes only. Other arrangements and methods may be implemented by those skilled in the art without departing from the scope and spirit of this invention. Moreover, those skilled in the art will envision other modifications within the scope and spirit of the claims appended hereto.

What is claimed is:

1. A lubricating oil composition comprising (a) a major amount of an oil of lubricating viscosity; (b) about 1600 ppm to about 3000 ppm as Ti metal of one or more non-halogen-containing oil-soluble titanium complexes comprising at least one ligand comprising an anion of a carboxylic acid; (c) about 0.5 wt. % to about 8 wt. %, based on the total weight of the lubricating oil composition, of one or more dispersants; and (d) about 0.2 wt. % to about 8 wt. %, based on the total weight of the lubricating oil composition, of at least two metal-containing detergents including a first metal-containing detergent concentrate which is an overbased alkaline earth metal sulfonate or phenate detergent concentrate or mixture thereof having a BN of about 100 to about 450 and a second metal-containing detergent concentrate which is an overbased alkaline earth metal sulfonate or phenate detergent concentrate or mixture thereof having a BN of about 10 to about 50, wherein the lubricating oil composition is free of any zinc dialkyldithiophosphate, has a sulfated ash content of no more than about 1.0 wt. % as determined by ASTM D874 and is substantially free of any phosphorus content.

2. The lubricating oil composition of claim 1, wherein the lubricating oil composition is an internal combustion engine oil.

3. The lubricating oil composition of claim 1, wherein the one or more non-halogen-containing oil-soluble titanium complexes comprise at least two ligands comprising the same or different anion of a carboxylic acid.

4. The lubricating oil composition of claim 1, wherein the one or more non-halogen-containing oil-soluble titanium complexes comprise at least three ligands comprising the same or different anion of a carboxylic acid.

5. The lubricating oil composition of claim 1, wherein the one or more non-halogen-containing oil-soluble titanium complexes comprise four ligands comprising the same or different anion of a carboxylic acid.

6. The lubricating oil composition of claim 1, wherein the ligand comprising an anion of a carboxylic acid is derived from a $C_2$-$C_{30}$ monocarboxylic acid.

7. The lubricating oil composition of claim 6, wherein the $C_2$-$C_{30}$ monocarboxylic acid is a fatty acid.

8. The lubricating oil composition of claim 1, wherein the one or more dispersants comprise one or more ashless dispersants.

9. The lubricating oil composition of claim 1, wherein the one or more ashless dispersants comprise a bissuccinimide.

10. The lubricating oil composition of claim 1, further comprising at least one additive selected from the group consisting of an antioxidant, anti-wear agent other than zinc dialkyldithiophosphate, rust inhibitor, dehazing agent, demulsifying agent, metal deactivating agent, friction modifier, pour point depressant, antifoaming agent, co-solvent, package compatibiliser, corrosion-inhibitor, dye, extreme pressure agent and mixtures thereof.

* * * * *